US009261304B2

(12) United States Patent
Tunzi

(10) Patent No.: US 9,261,304 B2
(45) Date of Patent: Feb. 16, 2016

(54) ADJUSTABLE DIVIDER ASSEMBLY FOR REFRIGERATOR STORAGE UNIT

(71) Applicant: Whirlpool Corporation, Benton Harbor, MI (US)

(72) Inventor: Todd J. Tunzi, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 95 days.

(21) Appl. No.: 13/753,557

(22) Filed: Jan. 30, 2013

(65) Prior Publication Data

US 2014/0210331 A1 Jul. 31, 2014

(51) Int. Cl.

| | |
|---|---|
| ***A47B 88/20*** | (2006.01) |
| ***F25D 25/00*** | (2006.01) |
| *A47F 5/00* | (2006.01) |

(52) U.S. Cl.

CPC ..... *F25D 25/00* (2013.01); *A47B 2088/202* (2013.01); *A47F 5/005* (2013.01); *Y10T 29/49826* (2015.01)

(58) Field of Classification Search

CPC ..... A47B 88/20; A47B 2088/20; A47B 2088/1202; A47B 2088/202; B65D 25/04; B65D 25/06; F25D 23/12; A47F 5/005

USPC ..... 312/401, 402, 404, 407, 348.3; 62/382; 220/528, 529, 531, 551; 248/173, 448, 248/458, 460

See application file for complete search history.

(56) References Cited

U.S. PATENT DOCUMENTS

| | | | | |
|---|---|---|---|---|
| 1,290,186 | A * | 1/1919 | Held | A47J 36/20 126/9 B |
| 2,148,681 | A * | 2/1939 | Cameron | 220/551 |
| 2,728,482 | A | 12/1955 | Driver | |
| 3,067,903 | A * | 12/1962 | Jones, Jr. | 220/552 |
| 3,308,964 | A | 3/1967 | Pistone | |
| 4,488,653 | A | 12/1984 | Belokin | |
| 4,964,528 | A | 10/1990 | Wagoner | |
| 5,775,523 | A | 7/1998 | Teringo | |
| 5,803,276 | A | 9/1998 | Vogler | |
| 6,073,794 | A * | 6/2000 | Bidot | 220/529 |
| 6,105,654 | A | 8/2000 | Martel | |
| D473,080 | S * | 4/2003 | Kellogg | D6/491 |
| 6,685,037 | B1 | 2/2004 | Zadak | |
| 6,880,903 | B2 | 4/2005 | O'Halloran et al. | |
| 6,991,307 | B2 | 1/2006 | Hoenig | |
| 7,163,119 | B2 | 1/2007 | Besselman | |
| 7,475,562 | B2 * | 1/2009 | Jackovin | 62/344 |
| 7,490,915 | B2 | 2/2009 | O'Halloran et al. | |
| D596,431 | S | 7/2009 | Berger | |
| 7,566,105 | B2 | 7/2009 | Janda et al. | |
| 2001/0004817 | A1 * | 6/2001 | Auer | 52/238.1 |
| 2003/0042388 | A1 * | 3/2003 | Peterson | F16M 11/20 248/440.1 |
| 2003/0137227 | A1 * | 7/2003 | Hoenig | 312/348.3 |

(Continued)

FOREIGN PATENT DOCUMENTS

GB 2019365 A 10/1979

*Primary Examiner* — James O Hansen

(57) ABSTRACT

An adjustable divider assembly for a pan, drawer or other storage unit of a refrigerator is constituted by multiple, pivotally interconnected sections which can be selectively angled relative to each other and/or varied in length to establish a desired configuration for compartmentalizing the storage unit. The adjustable divider assembly can carry various spaced magnets which are attracted to a metallic property of a support surface of the storage unit to retain the divider assembly in the desired configuration.

19 Claims, 4 Drawing Sheets

(56) References Cited

U.S. PATENT DOCUMENTS

2003/0184198 A1* 10/2003 Bodingbauer ..... 312/348.3
2004/0145287 A1* 7/2004 Ernst ..... 312/348.3
2007/0159040 A1* 7/2007 Fernandez et al. ..... 312/348.3
2008/0129167 A1* 6/2008 Rand et al. ..... 312/330.1
2009/0255891 A1 10/2009 Lanning

* cited by examiner

ADJUSTABLE DIVIDER ASSEMBLY FOR REFRIGERATOR STORAGE UNIT

BACKGROUND OF THE INVENTION

1. Field of the Invention

The present invention pertains to the art of refrigerators and, more particularly, to an adjustable divider used to selectively separate a storage unit in a refrigerator.

2. Description of the Related Art

In the art of refrigerators, it is widely known to employ a plurality of shelves and compartments, including drawers, bins and pans, to store a wide range of food products. For instance, in a fresh food compartment, shelves, drawers, pans, removable bins and the like are commonly found both in the body of the compartment and on the inside of the door for storing food items. When storing the food items, it is generally undesirable to enable excessive shifting. This is particularly true in connection with door supported food items in order to prevent the food items from falling when the door is abruptly opened or closed. To address this concern, it is known to employ retainers in connection with door supported shelves, bins, dairy compartments and the like to divide the storage zones, while limiting the potential shifting of the food items.

While retainers of this kind have been advantageously employed in connection with shelves and other storage zones on refrigerator doors, little has been done in effectively providing dividers for use in connection with refrigerator drawers, bins and the like. That is, a typical slidable drawer or bin in a refrigerator defines a single compartment for the storage of food items which are generally laid on top of one another or simply allowed to shift within the compartment over time. Obviously, such an arrangement does not represent an efficient and effective overall storage configuration. Although the storage compartment could be molded or otherwise formed with one or more dividers in order to establish multiple storage zones, it would be desirable to have an adjustable divider which could be used to selectively section off and reconfigure the overall storage region of a refrigerator drawer, bin or the like storage unit for improved organizational purposes.

SUMMARY OF THE INVENTION

The present invention is directed to an adjustable divider assembly for a support surface of a pan, drawer or the like storage unit in a refrigerator wherein the adjustable divider assembly constitutes multiple, pivotally interconnected arms, each of which includes telescoping sections. With this arrangement, each arm of the divider assembly can be selectively extended and retracted and the two arms can be readily angled relative to one another. Therefore, the overall adjustable divider assembly can assume any one of an essentially infinite number of positions to compartmentalize a storage region into multiple zones. In accordance with one form of the invention, the support surface has associated therewith a metal layer and the adjustable divider assembly includes base magnets which are attracted to the metal layer to retain the adjustable divider assembly in a desired configuration.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF PREFERRED EMBODIMENTS

Figure 1:
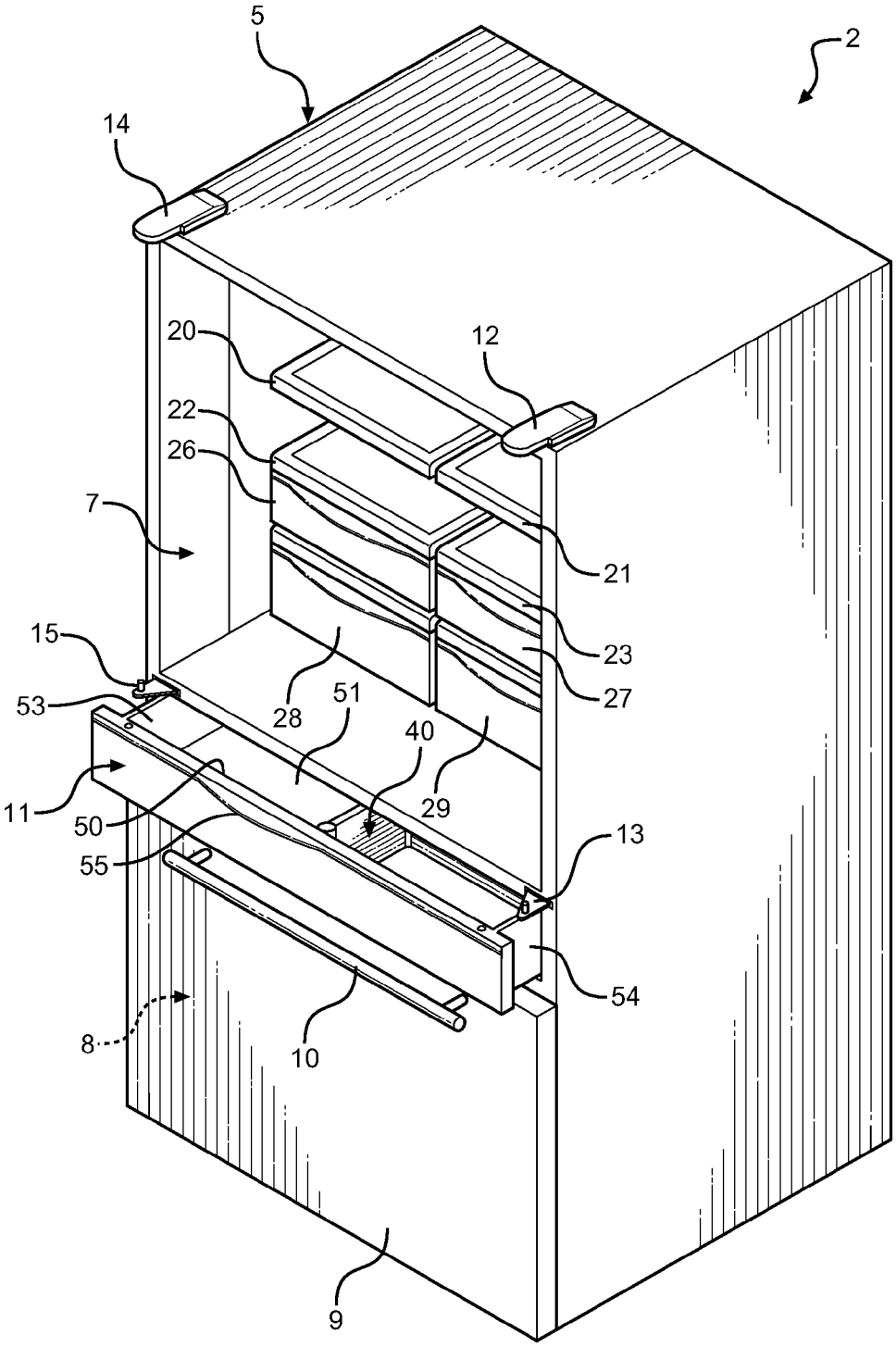
FIG. 1 is a perspective view of a refrigerator provided with the adjustable divider of the invention shown positioned within a storage compartment.

With initial reference to FIG. 1, a refrigerator incorporating the present invention is generally indicated at 2. As shown, refrigerator 2 includes a cabinet 5 within which is defined an upper fresh food compartment 7, a lower freezer compartment 8 located behind a freezer door 9 having a handle 10, and an intermediate refrigerated compartment defined by a drawer 11. Also depicted are pairs of upper and lower hinges 12, 13 and 14, 15 which are used in connection with pivotally mounting French-style upper fresh food compartment doors of refrigerator 2, with the fresh food compartment doors not being shown in order to illustrate internal components of refrigerator 2. At this point, it should be realized that, although refrigerator 2 is shown to constitute a bottom mount style refrigerator, the invention is equally applicable to other refrigerator styles, including other bottom mount, top mount and side-by-side units.

In the embodiment shown, fresh food compartment 7 includes a plurality of spaced shelves 20-23, as well as a plurality of storage drawers or bins 26-29. Below fresh food compartment 7 is drawer 11 which extends across substantially the entire width of cabinet 5. At this point, it should be noted that drawer 11 can be completely separate from fresh food compartment 7 as depicted or located within fresh food compartment 7, such as below storage drawers 27 and 28 in a manner known in the art. In any case, the present invention is particularly directed to the inclusion of one or more adjustable divider assemblies 40 for refrigerator 2. In the embodiment shown, one adjustable divider assembly 40 is shown arranged within storage drawer 11. More specifically, drawer 11 is shown to include a front wall 50, a base or bottom wall 51, a rear wall 52 (shown in FIGS. 5-10) and a pair of opposing side walls 53 and 54. FIG. 1 depicts drawer 11 partially opened. However, front wall 50 is provided with a handle 55 which can be selectively grasped to slide storage drawer 11 between an extended, access position and a recessed, storage position. Although most of drawer 11 is molded of plastic, bottom wall 51 of storage drawer 11 is preferably formed of metal or at least includes a metallic surface layer as will be detailed more fully below.

Figure 2:
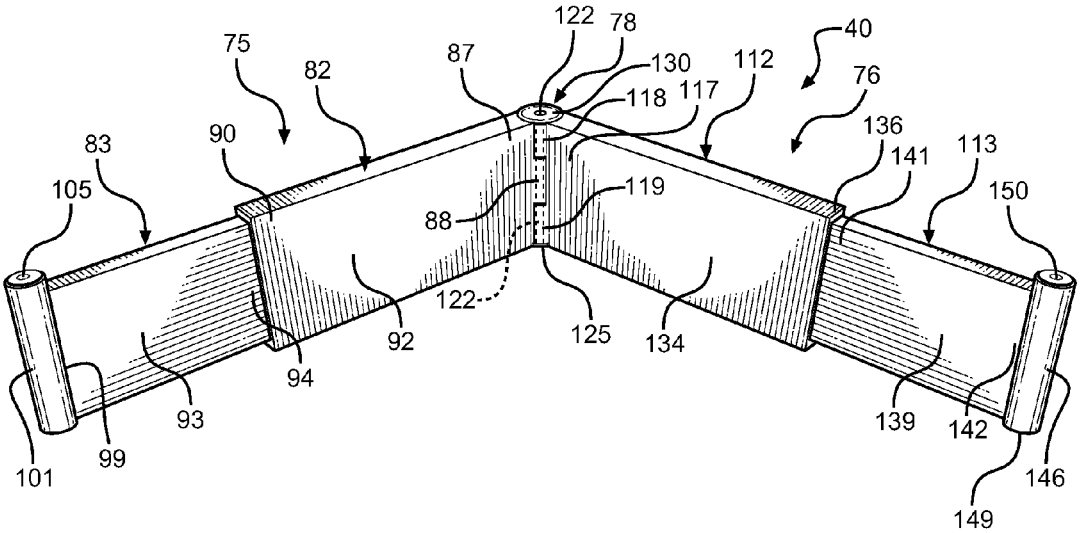
FIG. 2 is a perspective view of the adjustable divider from FIG. 1.
Figure 3:
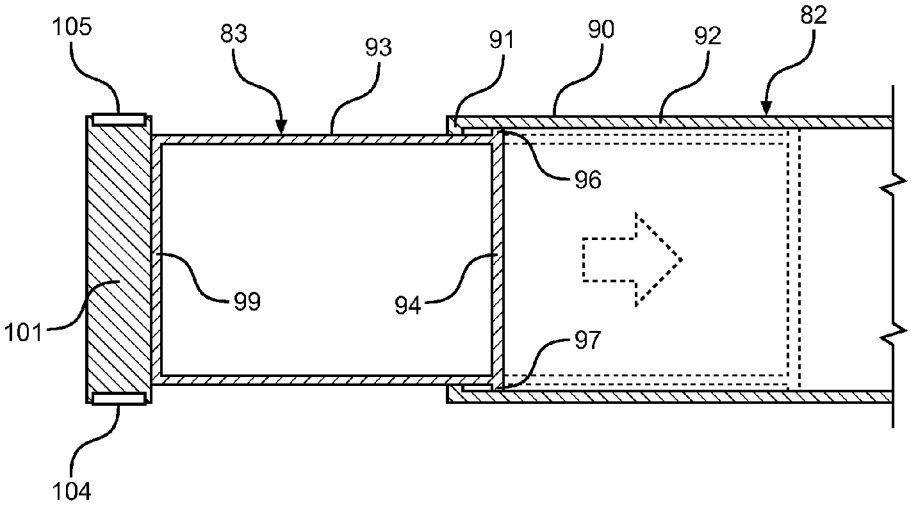
FIG. 3 is a cross-sectional view of a portion of the divider of FIG. 2.
Figure 4:
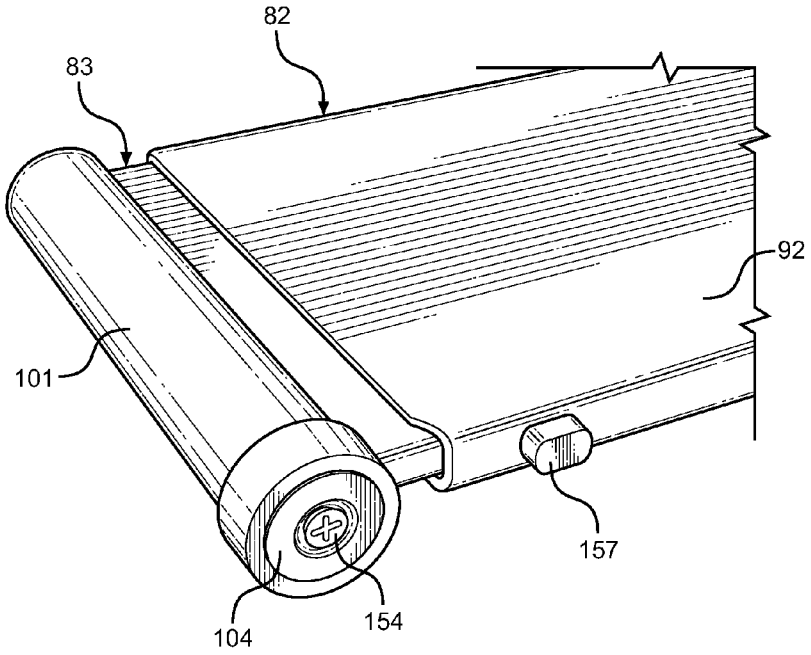
FIG. 4 is an enlarged perspective view of a lower corner portion of the divider of FIG. 2.

Reference will now be made to FIGS. 2-4 is describing the construction of adjustable divider assembly 40 in accordance with an embodiment of the invention. In general, adjustable divider assembly 40 can be made from various materials, including plastic, metal or a combination thereof. In any event, adjustable divider assembly 40 is constituted by two main, telescopic, substantially symmetrical arms or sections 75 and 76 which are pivotally interconnected at a connector joint 78. As illustrated, arm 75 includes a housing portion 82 and an extension portion 83 which is telescopingly received within housing portion 82. More specifically, housing portion 82 includes a first end 87 from which projects a central tubular member 88. Housing portion 82 also includes a second end 90 which, as best shown in FIG. 3, includes an in-turned terminal end 91. In general, housing portion 82 establishes a central hollow body portion 92.

As also shown in these figures, extension portion 83 includes a first end 94 which is received within housing portion 82 and which includes upper and lower projections 96 and 97 respectively (again see FIG. 3). As will be readily evident from viewing FIG. 3, when extension portion 83 is moved to a fully extended position relative to housing portion 82, upper and lower projections 96 and 97 abut in-turned terminal end 91 to limit the degree of extension and prevent extension portion 83 from being disconnected from housing portion 82. Extension portion 83 also includes a second end 99 which is secured to an end support block 101. In the embodiment depicted, end support block 101 has mounted thereto a lower magnet 104 and, optionally, an upper magnet 105.

In a similar manner, arm 76 is also defined by a housing portion 112 and an extension portion 113. At this point, it should be recognized that arms 75 and 76 are substantially symmetrical. However, housing portion 112 of arm 76 includes a first end portion 117 provided with both an upper tubular member 118 and a lower tubular member 119. Between upper and lower tubular members 118 and 119 is positioned central tubular member 88 of arm 75 and a pivot pin 122 extends through upper tubular member 118, central tubular member 88 and lower tubular member 119 in order to pivotally interconnect arms 75 and 76. With this arrangement, it should be recognized that the illustrated pivotal connection permits relative rotation between arms 75 and 76 through at least 180° with pivot pin 122 establishing a rotational axis for this movement. However, it should also be recognized that other constructions could be employed to pivotally interconnect arms 75 and 76. For example, arms 75 and 76 could be identically constructed and pivot establishing plates could be mounted to the top and bottom of one housing portion 82, 112 in a cantilevered manner such that one or more pivot pins could extend into the other housing portion 112, 82 through the cantilevered sections such that the arms 75 and 76 are basically interconnected with pivot brackets. In any case, it should be readily apparent that various connections could be employed to provide for at least the 180 degrees of relative pivoting. In addition, pivot pin 122, tubular member 118, central tubular member 88 and lower tubular member 119 combine to establish a central support block 125 which, in a manner similar to end support block 101, can be provided with upper and lower magnets, one of which is indicated at 130 in FIG. 1.

For the sake of completeness, it should be noted that housing portion 112 of arm 76 includes a central hollow body portion 134 having a second end portion 136 which is identically constructed to second end 90 of housing portion 82. Also, extension portion 113 is identically constructed to extension portion 83 so as to include a main body 139, a first end portion 141 and a second end portion 142 which terminates in an end support block 146 having mounted thereto, at one end, a first magnet 149 and, at a second end, another magnet 150.

Reference will now be made to FIG. 4 to illustrate further details of adjustable divider assembly 40. As shown, extension portion 83 is almost fully retracted within housing portion 82. This figure also illustrates the manner in which magnet 104 is substantially recessed within end support block 101 and secured thereto by a mechanical fastener, such as a screw 154. Also illustrated in this figure is the potential inclusion of one or more additional support posts, such as support post 157, provided along hollow body portion 92, preferably directly adjacent extension portion 83.

Figure 5:
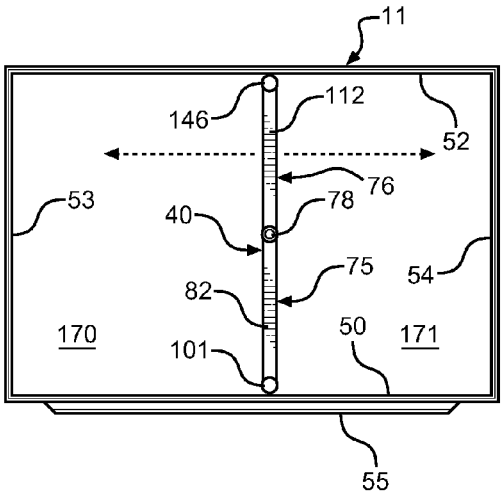
FIGS. 5-10 illustrate various potential configurations for the adjustable divider within the compartment of FIG. 1.
Figure 6:
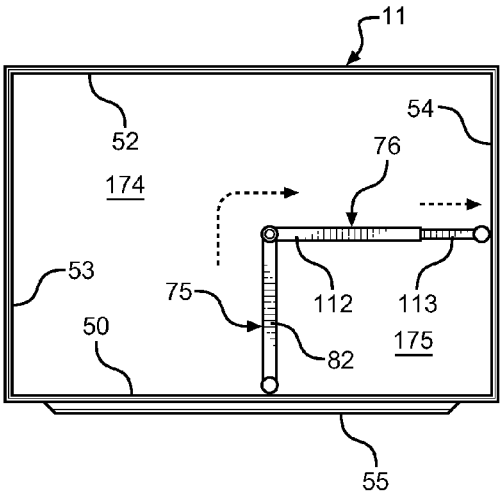
Figure 7:
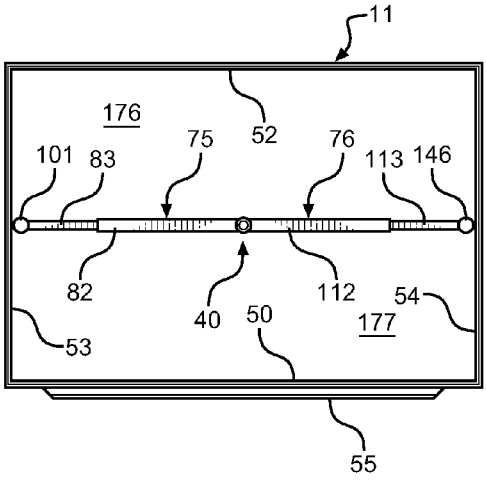

With the above construction, adjustable divider assembly 40 can be advantageously utilized to divide a storage compartment into multiple storage zones. More specifically, adjustable divider assembly 40 can be selectively varied in length and configuration such that there is essentially an infinite number of positions which can be established. By way of example, reference is made to FIGS. 5-10 which illustrate the manner in which adjustable divider assembly 40 can be utilized to compartmentalize the storage region established by drawer 11 into multiple storage zones. That is, as shown in FIG. 5, extension portions 83 and 113 of arms 75 and 76 are shown to be fully retracted within housing portions 82 and 112 respectively, while the overall adjustable divider assembly 40 is positioned upon bottom wall 51 and extends between front wall 50 and rear wall 52. In this figure, adjustable divider assembly 40 establishes laterally spaced storage zones 170 and 171 which are nearly of equal volume. Of course, adjustable divider assembly 40 could be repositioned to the left or right in this figure to vary the relative sizes of storage zones 170 and 171. In FIG. 6, it is shown wherein arm 76 has been pivoted essentially 90° and extension portion 113 has been extended in order to reach side wall 54. Therefore, this arrangement establishes storage zones 174 and 175, with storage zone 174 being approximately three times the size of storage zone 175. Instead of extending between front wall 50 and rear wall 52 as shown in FIG. 5, adjustable divider assembly 40 can also extend between side walls 53 and 54. This arrangement is shown in FIG. 7 wherein extension portions 83 and 113 are shown abutting side walls 53 and 54 respectively, thereby dividing drawer 11 into storage zones 176 and 177. In a manner directly corresponding to that discussed above with respect to FIG. 5, it should be readily recognized that adjustable divider assembly 40 could be shifted either closer to or farther from rear wall 52 in order to further vary the relative sizes of storage zones 176 and 177.

Figure 8:
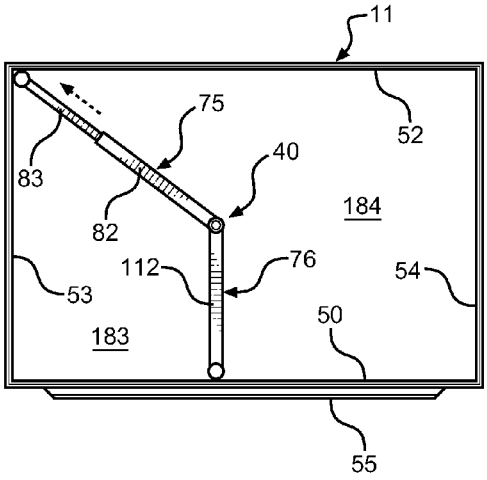
Figure 9:
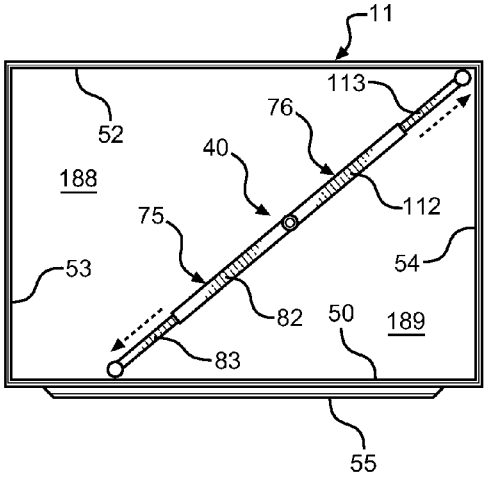
Figure 10:
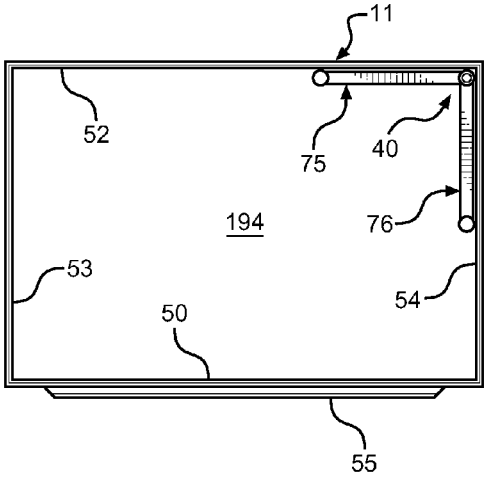

Certainly, there is an extremely wide variety of configurations which can be achieved utilizing adjustable divider assembly 40. FIG. 8 illustrates another arrangement wherein arm 75 is shown to be extended such that extension portion 83 is located within the corner between rear wall 52 and side wall 53, while arm 76 is shown fully retracted and is positioned against front wall 50. In a still further variation, FIG. 9 shows an arrangement wherein arms 75 and 76 are both shown to be partially extended, with extension portion 83 abutting front wall 50 and extension portion 113 being arranged in a corner between rear wall 52 and side wall 54. When not in use, adjustable divider assembly 40 can be selectively placed in a fully retracted configuration with arms 75 and 76 being arranged in a corner for storage purposes. For example, FIG. 10 shows arm 75 extending along rear wall 52 and arm 76 extending along side wall 54 such that the overall adjustable divider assembly 40 is out of the way, yet conveniently accessible for reconfiguring drawer 11 as desired.

Although described with reference to preferred embodiments of the invention, it should be readily understood that various changes and/or modifications can be made to the invention without departing from the spirit thereof. For instance, although the adjustable divider assembly is disclosed in connection with a storage drawer which extends across substantially the entire width of a refrigerator, the adjustable divider assembly could also be employed in connection with any storage compartment, including smaller drawers, pans, bins and the like. In accordance with the invention, it should also be realized that the adjustable divider assembly can be mounted in a wide variety of ways. In the embodiment described above wherein each support block includes associated magnets, the support surface upon which adjustable divider assembly is mounted preferably has associated therewith a metal layer to which the magnets are attracted. Therefore, in the embodiment described, base or bottom wall 51 of intermediate refrigerated compartment 11 would have an associated metallic property. This property can be established by forming bottom wall 51 of metal, incorporating metallic particles therein, or having a metal layer associated therewith, either exposed at the surface or below a thin plastic or glass layer. In any case, the magnets would be attracted to the metallic surface to retain the adjustable divider assembly in a desired configuration. Certainly, if adjustable divider assembly 40 was not designed to be invertible, adjustable divider assembly 40 would not require magnets 105, 130 or 150. On the other hand, the adjustable divider assembly could employ magnets when resting on one side and no magnets when inverted. For instance, friction pads or the like could be employed for retention purposes. In general, the invention is only intended to be limited by the scope of the following claims.

What is claimed is:

1. A refrigerator comprising:

a cabinet including at least one refrigerated compartment;

a storage unit provided in the cabinet and including a substantially planar support surface; and an adjustable divider assembly provided on the support surface and including first and second pivotally interconnected and telescoping arms enabling the adjustable divider assembly to be selectively varied in length and configuration in order to divide the storage unit into multiple storage zones, wherein each of the first and second arms includes a housing portion and an extension portion, with the extension portion being slidably supported within the housing portion, and wherein the housing portion of the first arm is directly pivotally attached to the housing portion of the second arm for rotation about a pivot axis.

2. The refrigerator according to claim 1, wherein the first and second arms of the adjustable divider assembly can be rotated, relative to each other, through at least 180° .

3. The refrigerator according to claim 1, wherein the extension portion of each of the first and second arms is slidably mounted for linear extension in a direction away from the pivot axis and linear retraction in a direction toward the pivot axis.

4. The refrigerator according to claim 1, wherein the at least one refrigerated compartment includes an upper fresh food compartment, a lower freezer compartment and a drawer interposed vertically between said fresh food and freezer compartments, said adjustable divider assembly being mounted in the drawer, with the drawer constituting the storage unit and a bottom wall of the drawer constituting the support surface.

5. A refrigerator comprising:

a cabinet including at least one refrigerated compartment;

a storage unit provided in the cabinet and including a substantially planar support surface;

an adjustable divider assembly provided on the support surface and including first and second pivotally interconnected and telescoping arms enabling the adjustable divider assembly to be selectively varied in length and configuration in order to divide the storage unit into multiple storage zones, wherein each of the first and second arms includes a support block at a distal end thereof; and a plurality of magnets provided at spaced lower portions of the adjustable divider assembly, wherein at least one magnet of the plurality of magnets is provided on a lower face of each of the support blocks, and wherein the support surface includes a metallic property such that a magnetic attraction retains the adjustable divider assembly in a desired configuration upon the support surface.

6. The refrigerator according to claim 5, wherein each of the first and second arms includes a housing portion and an extension portion, with the extension portion being slidably supported within the housing portion.

7. The refrigerator according to claim 6, wherein the housing portion of the first arm is directly pivotally attached to the housing portion of the second arm for rotation about a pivot axis.

8. The refrigerator according to claim 5, wherein the support surface is constituted by a metal sheet.

9. The refrigerator according to claim 5, wherein a second plurality of magnets is provided at spaced upper portions of the adjustable divider assembly, and wherein a magnet of the second plurality of magnets is provided on an upper face of each of the support blocks such that a magnetic attraction retains the adjustable divider assembly in an inverted position upon the support surface.

10. The refrigerator according to claim 5, wherein the adjustable divider assembly further includes a central support block located at a pivot axis of the adjustable divider assembly, and wherein a magnet of the plurality of magnets is provided on a lower face of the central support block.

11. An adjustable divider assembly for a refrigerator storage unit including a support surface comprising:

first and second pivotally interconnected and telescoping arms enabling the adjustable divider assembly to be selectively varied in length and configuration in order to divide the storage unit into multiple storage zones, wherein each of the first and second arms includes a support block at a distal end thereof; and a plurality of magnets provided at spaced lower portions of the adjustable divider assembly for retaining the adjustable divider assembly in a desired configuration upon a support surface having a metallic property to which the plurality of magnets are attracted, wherein at least one magnet of the plurality of magnets is provided on a lower face of each of the supports blocks.

12. The adjustable divider assembly according to claim 11, wherein each of the first and second arms includes a housing portion and an extension portion, with the extension portion being slidably supported within the housing portion, and wherein the housing portion of the first arm is directly pivotally attached to the housing portion of the second arm for rotation about a pivot axis.

13. The adjustable divider assembly according to claim 12, wherein the extension portion of each of the first and second arms is slidably mounted for linear extension in a direction away from the pivot axis and linear retraction in a direction toward the pivot axis.

14. The adjustable divider assembly according to claim 11, wherein a second plurality of magnets is provided at spaced upper portions of the adjustable divider assembly, and wherein a magnet of the second plurality of magnets is provided on an upper face of each of the support blocks such that a magnetic attraction retains the adjustable divider assembly in an inverted position upon the support surface.

15. The adjustable divider assembly according to claim 11, further comprising: a central support block located at a pivot axis of the adjustable divider assembly, wherein a magnet of the plurality of magnets is provided on a lower face of the central support block.

16. A method of dividing a storage unit of a refrigerator into multiple storage zones, the refrigerator comprising a cabinet including at least one refrigerated compartment, a storage unit provided in the cabinet and including a substantially planar support surface and an adjustable divider assembly including first and second pivotally interconnected and telescoping arms, wherein each of the first and second arms includes a housing portion and an extension portion, with the extension portion being slidably supported within the housing portion, and wherein the housing portion of the first arm is directly pivotally attached to the housing portion of the second arm for rotation about a pivot axis, the method comprising:

positioning the adjustable divider assembly on the support surface of the storage unit;

pivoting the first and second arms of the adjustable divider assembly relative to each other; and adjusting a length of at least one of the first and second arms, whereby a desired configuration for the adjustable divider assembly is established to divide the storage unit into the multiple storage zones.

17. The method of claim 16, wherein adjusting a length of at least one of the first and second arms comprises shifting the extension portion of each of the first and second arms linearly in a direction either toward or away from the pivot axis defined between the first and second arms.

18. The method of claim 16 wherein, during pivoting of the first and second arms, the first and second arms of the adjustable divider assembly are rotated, relative to each other, through at least 180° .

19. The method of claim 16, wherein each of the first and second arms includes a support block at a distal end thereof, the method further comprising:

mounting the adjustable divider assembly to the support surface through magnetic attraction, wherein the mounting includes positioning a plurality of magnets provided at spaced lower portions of the adjustable divider assembly upon the support surface which has a metallic property, and wherein at least one magnet of the plurality of magnets is provided on a lower face of each of the support blocks.

* * * * *